US008130071B2

(12) United States Patent
Jost et al.

(10) Patent No.: US 8,130,071 B2
(45) Date of Patent: Mar. 6, 2012

(54) VARISTOR COMPRISING AN INSULATING LAYER PRODUCED FROM A LOADING BASE GLASS

(75) Inventors: Thomas Jost, Graz (AT); Andreas Schriener, Deutschlandsberg (AT); Harald Reisinger, Graz (AT); Gerd Klemen, Deutschlandsberg (AT)

(73) Assignee: EPCOS AG, Munich (DE)

( * ) Notice: Subject to any disclaimer, the term of this patent is extended or adjusted under 35 U.S.C. 154(b) by 697 days.

(21) Appl. No.: 11/574,780

(22) PCT Filed: Sep. 15, 2005

(86) PCT No.: PCT/DE2005/001622

§ 371 (c)(1), (2), (4) Date: Sep. 11, 2007

(87) PCT Pub. No.: WO2006/029610

PCT Pub. Date: Mar. 23, 2006

(65) Prior Publication Data

US 2008/0030296 A1 Feb. 7, 2008

(30) Foreign Application Priority Data

Sep. 15, 2004 (DE) ..... 10 2004 044 648

(51) Int. Cl.
*H01C 7/10* (2006.01)

(52) U.S. Cl. ..... 338/21; 338/114; 338/13; 361/111; 361/127

(58) Field of Classification Search ..... 338/20–21, 338/114, 13–15; 361/111, 117, 127
See application file for complete search history.

(56) References Cited

U.S. PATENT DOCUMENTS

| | | | | |
|---|---|---|---|---|
| 3,725,836 | A * | 4/1973 | Wada et al. | 338/21 |
| 3,959,543 | A * | 5/1976 | Ellis | 428/64.1 |
| 4,333,861 | A * | 6/1982 | Aoki et al. | 252/519.52 |
| 4,845,308 | A * | 7/1989 | Womack et al. | 174/15.4 |
| 5,286,269 | A | 2/1994 | Paschke | |
| 5,294,908 | A | 3/1994 | Katsumata et al. | |
| 5,294,909 | A | 3/1994 | Frazier | |
| 5,402,100 | A * | 3/1995 | Urbanek et al. | 338/21 |
| 5,497,138 | A * | 3/1996 | Malpiece et al. | 338/21 |
| 6,008,975 | A * | 12/1999 | Kester et al. | 361/117 |
| 6,507,269 | B2 | 1/2003 | Imai et al. | |
| 7,095,310 | B2 | 8/2006 | Imai et al. | |

FOREIGN PATENT DOCUMENTS

| | | |
|---|---|---|
| DE | 2 417 523 | 12/1974 |
| DE | 41 36 115 | 1/1993 |
| DE | 100 49 023 | 5/2001 |
| DE | 101 42 314 | 5/2002 |
| FR | 2 799 301 | 5/2000 |

(Continued)

OTHER PUBLICATIONS

Written Opinion for PCT/DE2005/001622.

(Continued)

*Primary Examiner* — Kyung Lee
(74) *Attorney, Agent, or Firm* — Fish & Richardson P.C.

(57) ABSTRACT

A varistor includes a ceramic base body having a surface. The varistor also includes an insulating layer on at least a portion of the surface of the ceramic base body. The insulating layer includes a base glass and filler. The filler includes $3Al_2O_32SiO_2$.

14 Claims, 3 Drawing Sheets

FOREIGN PATENT DOCUMENTS

| | | |
|---|---|---|
| JP | 54-073264 | 6/1979 |
| JP | 60-219704 | 11/1985 |
| JP | 3-91201 | 4/1991 |
| JP | 05-29108 | 2/1993 |
| JP | 06-96907 | 4/1994 |
| JP | 7-297011 | 11/1995 |
| JP | 08-172002 | 7/1996 |
| JP | 2000-286107 | 10/2000 |
| JP | 2002-305104 | 10/2002 |

OTHER PUBLICATIONS

International Search Report for PCT/DE2005/001622.
English translation of IPER for PCT/DE2005/001622.
English translation of Examination Report dated Oct. 22, 2010 for corresponding application JP 2007-531590.
Notice of Allowance for Japanese Patent Application No. 2007-531590 dated May 18, 2011.

* cited by examiner

VARISTOR COMPRISING AN INSULATING LAYER PRODUCED FROM A LOADING BASE GLASS

FIELD OF THE INVENTION

The invention relates to a varistor.

BACKGROUND

Zinc oxide (ZnO) power varistors are nonlinear, voltage-dependent resistor bodies that comprise ceramic sintered bodies based on zinc oxides as the resistance element. For varistors the electrical resistance decreases strongly with rising voltage above a response voltage. Due to this electrical behavior, varistors are used to protect electrical systems and equipment from overvoltages and voltage peaks. The varistor in this case is connected in parallel to the electrical system to be protected, and by virtue of its current-voltage characteristic, limits the maximum voltage appearing at the electrical system. Electrodes for electrical contacting of the varistors are applied to both end faces of the cylindrical main body of the varistors.

Overvoltages and voltage peaks can be subdivided on a time axis roughly into lightning strike overvoltage (time range: microseconds), switching overvoltages (time range: milliseconds) and temporary overvoltages (time range: seconds). Overvoltages in the microsecond range, in particular, can reach very high voltage peaks. Not only do these very fast and very high voltage peaks stress the zinc oxide ceramic of the varistor strongly, a breakdown also occurs without suitable countermeasures on the outer side or surface of the varistor.

A zinc oxide varistor in which the generated surface of the ceramic base body is coated with a high-resistance layer is known from U.S. Pat. No. 5,294,909. The crystallized glass composition for wetting the ceramic base body comprises lead oxide (PbO) as its main component and is enriched with the components ZnO, $B_2O_3$, $SiO_2$, $MoO_3$, $WO_3$, $TiO_2$ and NiO to promote the crystallinity and the insulating property of the layer. The addition of larger amounts of PbO to the insulating layer raises its coefficient of thermal expansion, the addition of larger amounts of ZnO enabling the crystallization of the glass composition of the layer. The addition of larger amounts of $B_2O_3$, on the other hand, leads to a reduction of the crystallization of the layer, particularly if the weight proportion of $B_2O_3$ exceeds 15%. The elevation of the $SiO_2$ also leads to the reduction of crystallization, with simultaneous elevation of the coefficient of thermal expansion.

Arresters consisting of varistors are subject in use over long periods (service life≧30 years) to environmental influences such as moisture and chemical contaminants. There is the danger that these environmental influences may lead to a reduction of the varistor's ZnO ceramic and change the current-voltage characteristic. The function of protection from environmental influences is taken on here by the protective coating.

SUMMARY

Methods for increasing the breakdown strength of a varistor are disclosed. In addition, methods for protecting the ceramic of a varistor can from environmental influences are disclosed.

A varistor is proposed that comprises a ceramic base body, the surface of which is furnished at least in part with an insulating layer composed of a base glass and a filler, the filler containing $3Al_2O_3 2SiO_2$.

A high dielectric strength, which is co-responsible for a good breakdown strength of the varistor, is provided by the aforementioned composition.

Moreover, the insulating layer is of no concern regarding its environmental compatibility since it need not contain any lead. The layer is advantageously free of lead.

It is preferred that the layer comprise a filler content of 5 to 40%. The filler content manages to reduce the coefficient of thermal expansion of the insulating layer in order to avoid crack formation in the layer. Another effect that can be achieved with a filler content in this range is a lower coefficient of thermal expansion of the layer than that of the varistor's ceramic base body.

It is favorable if zinc oxide constitutes a weight content of 30 to 50% of the base glass.

Also proposed is a varistor that comprises a ceramic base body in which a layer that contains material-strengthening fibers is applied to at least part of the area of the ceramic base body.

The body is given a high strength by the material-strengthening fibers, so that the layer does not crack or split under elevated thermal or mechanical stress.

The layer preferably seals the ceramic base body, at least in part, hermetically against the outside, so that the oxygen necessary for ignition of the electrical component or the ceramic base body cannot penetrate to the hot ignition source of the varistor or the ceramic base body. For lack of oxygen, the varistor cannot ignite even with a considerable overvoltage.

Another advantage of the high-strength layer is that the escape of harmful materials of the ceramic base body to the outside is prevented. The potential toxicity to a user is thus reduced.

Thermal insulation of the electrical component against the environment is additionally guaranteed by the layer, so that burning of a user in case of contact with the varistor is made more difficult and thus the potential for hazard is reduced.

It is preferred that the layer comprise fire-resistant or at least fire-retardant materials. Should the electrical component or the ceramic base body be ignited, for instance, under extreme pressure or temperature conditions, despite the high layer strength, the flame-retardant materials of the layer can slow propagation of the combustion.

Protection from application of fire from the outside is likewise achieved with such a fire-resistant layer. The danger of ignition of the entire electrical component, or of propagation of the combustion to an array of several components, can be reduced with this measure.

According to one embodiment the material-strengthening fibers are added to the mullite mixture. An insulating layer with a high breakdown and material strength is thus created. If flame-retardant materials are additionally added to the mullite mixture, the fire resistance of the varistor or the insulating layer can be increased.

The invention will be described in detail on the basis of the following embodiments and figures. Here:

DETAILED DESCRIPTION

Stress cases in the sense of a direct lightning strike are anchored in 1EC Standard 60099-4 as 4/10 μs tests. The 4/10 test has a rise time of 4 μs up to the peak current, with the decay time to a 50% value of the peak value amounting to 10 μs. For arresters of the 10 kA and 20 kA class, stressing with two pulses with a peak current of 100 kA each is prescribed, without a sparkover occurring on the arrester or varistor. Loads corresponding to the 4/10 test will be referred to below in this document as pulse loads.

Figure 1:
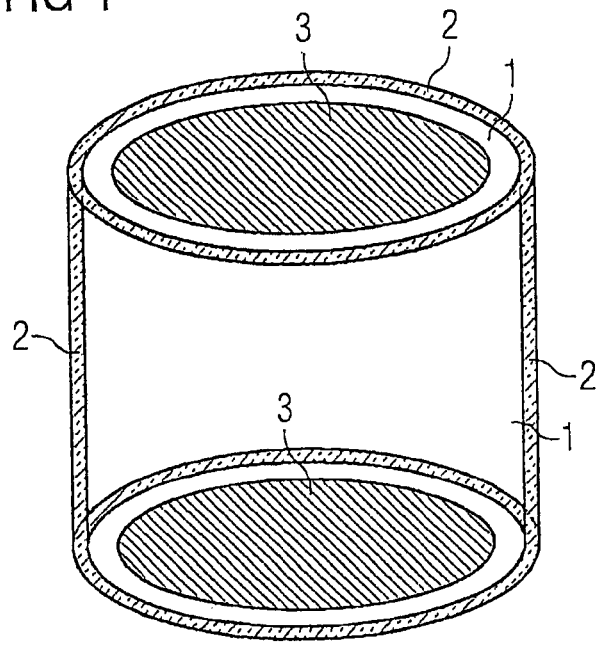
FIG. 1 shows a varistor, furnished on its end face with metallizations and on its side surface with an insulating layer.

FIG. 1 shows a varistor with a ceramic base body 1, the surface of which is furnished with an insulating layer 2, and the end faces of which are furnished with a metallization or electrodes 3. In particular, the side surface of base body 1 is furnished with the insulating layer. A composite glaze consisting of a base glass and a filler is proposed for the insulating layer. The base glass containing 30-50% ZnO, 30-40% $B_2O_3$, 0-10% CuO and 0-10% $P_2O_3$. Mullite ($3Al_2O_3$ $2SiO_2$) in a range of 5-40% is used as the filler. The filler is added in powder form (grain size 0-22 μm) to the glass layer or glaze.

During the glass firing, the base glass or glass frit melts, runs and forms a glass-like protective coating of the varistor. The temperature of the glass firing is well below the melting point of the filler grains, which is why they do not melt and are embedded unchanged in the base glass.

A filler content between 5 and 40% has proved advantageous for the composite glaze or insulating layer.

The application of the insulating layer can be carried out, for instance, with the following steps:

1) Mixing of the base glass frit with the mullite filler, water and a binder.

2) Application of the resulting paste by means of spraying technology or paste printing technology.

3) Firing of the glass paste at 600-680° C., the annealing temperature being thereby reached and the long-term stability of the ceramic temperature improved.

In order to influence the current-voltage characteristic of the varistors only slightly or not at all, the temperature in the production step of coating the ZnO ceramic must not be too high. Therefore only glasses with low melting points should be used. In the past, however, glasses with a low melting point and good insulating capability for power varistors could be implemented only with lead-containing glasses or glasses based on bismuth, lead-containing glasses being unable to meet environmental requirements and glasses based on bismuth being expensive due to the high bismuth raw material costs. On the other hand, organic lacquers represent an economical possibility for protective coating, but are hampered by deficiencies in regard to the desired long-term stability of power varistors.

Thermal shock resistance is an important point for the pulse resistance of protective coatings or insulating layers. With a pulse load, the temperature of the power varistor can rise within microseconds by up to 150° C. If the coefficient of thermal expansion of the protective coating is greater than that of the ceramic, this stress leads to increased crack formation in the protective coating and thus to a poor pulse resistance. Low-melting glasses consistently have too large a coefficient of thermal expansion by comparison to a zinc oxide ceramic, so that the pulse resistance thus remains unsatisfactory.

The admixture of filler with very low coefficient of thermal expansion to the base glass, on the other hand, leads to lower coefficients of thermal expansion of the insulating layer. Thus the coefficient of thermal expansion of the glaze is reduced by the addition of the mullite filler. By optimizing the coefficient of expansion of the composite glaze, it can be adapted to roughly the value of the coefficient of expansion of the varistor's zinc oxide ceramic.

The following table ≠[In the table, commas in numbers represent decimals.] shows the coefficient of thermal expansion of varistor ceramic and a composite glaze for various temperatures.

| T (° C.) | α1 $10^{-7}$ ($K^{-1}$) | α2 $10^{-7}$ ($K^{-1}$) |
|---|---|---|
| 150 | 59.7 | 56.0 |
| 200 | 64.3 | 57.7 |
| 250 | 67.0 | 60.1 |
| 300 | 69.2 | 61.2 |
| 360 | 69.6 | 62.4 |
| 400 | 70.8 | 63.6 |
| 450 | 71.9 | 64.9 |
| 500 | 73.4 | 66.4 |
| 550 | 71.5 | 87.5 |

The values T, α1, α2, respectively represent the temperature, the coefficient of thermal expansion of the varistor ceramic and the coefficient of thermal expansion of the insulating layer or composite glaze.

The varistor can be constructed as a multilayer varistor with integrated internal electrodes, the contact bodies in this case being preferably arranged on the side surface of the base body. Each contact body is contacted with one end of an internal electrode; also see FIG. 5 in this regard.

Figure 2:
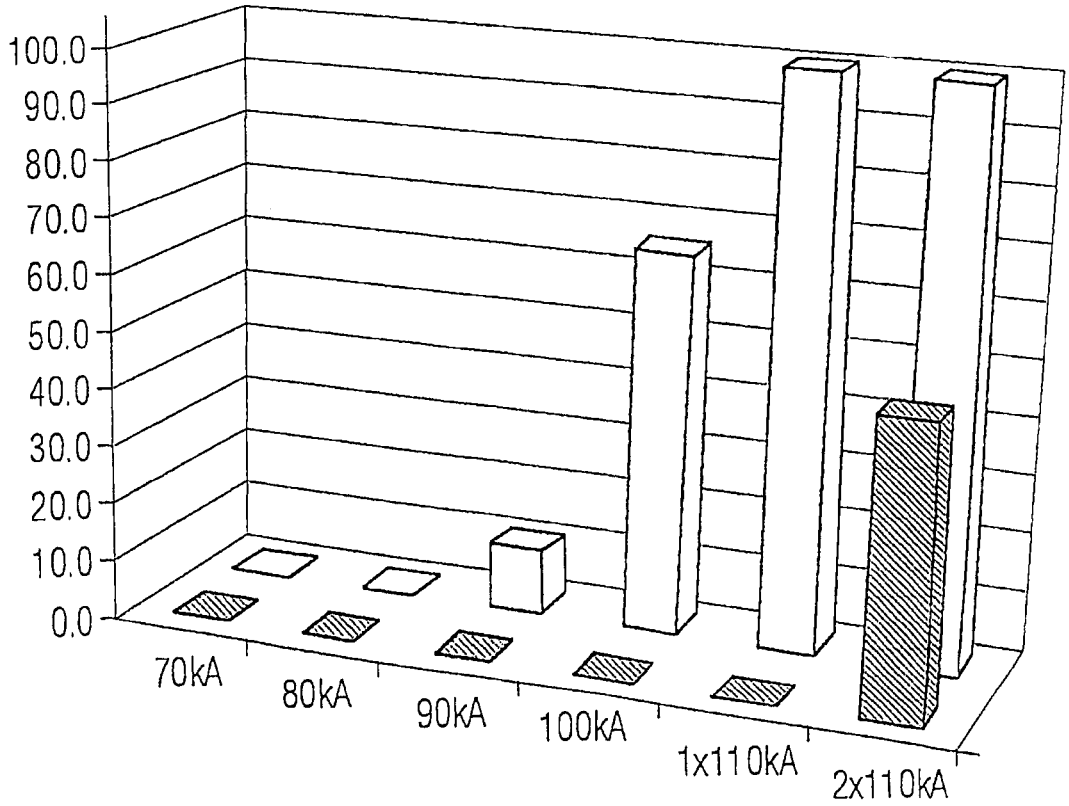
FIG. 2, a graphic representing the failure rate of varistors with and without a $3Al_2O_3 2SiO_2$ insulating layer at various current loads.

FIG. 2 is a graphical representation of the failure rate of varistors with and without an insulating layer containing mullite, under rising pulse load. The vertical axis represents the cumulative failure rate in percent of the varistors, while the horizontal axis represents the applied pulse current in amperes. The dark bars show the behavior of varistors that are furnished with an insulating layer comprising mullite. It is clearly recognizable in this case how the failure rates of such varistors begin to rise only at a relatively high value of 110 kA (110 kiloamperes), particularly if this pulse is applied in short time spans one after the other. On the other hand, the failure rate of varistors without a layer comprising mullite begins to rise already at 90 kA. The content of mullite by weight in the insulating layer of the varistors represented by the gray {white} bars is 20%. Power varistors with a height of 44 mm and a diameter of 43.5 mm were used.

A composite glaze comprising mullite therefore has a coefficient of thermal expansion that is optimized by design. The glaze also has a very good mechanical strength, which also has a positive effect on the pulse resistance. Thus the flexural tensile strength with a 20% mullite content is 78 MPa.

The present composite glaze also advantageously protects ceramic due to its glass-like melting. It is nontoxic as well and is not a concern regarding environmental compatibility, in particular, since it can also be compounded lead-free. The glaze likewise need not contain any bismuth, so that it is more economical than the alternative currently used. The mullite used as a filler has a low coefficient of thermal expansion, in the range of $40*10^{-7}(K^{-1})$ and a high melting point at >1800° C. It is assured by the high melting point that no, or at worst only slight, chemical and/or physical transformation of the filler takes place during firing of the glaze.

Figure 3:
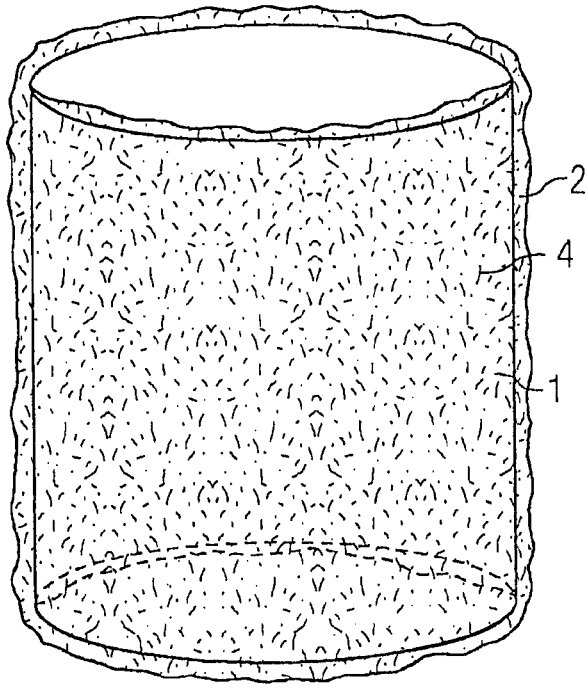
FIG. 3, a varistor with an outer layer comprising fibers.

FIG. 3 shows a varistor, the surface of which is furnished at least in part with a insulating layer 2 that contains fiber composite materials 4. The fiber composite materials are preferably added to the above-described mullite mixture. The layer preferably seals an internal area of the ceramic base body hermetically against the exterior.

A substantial strength increase of the insulating protective coating 2 of the varistor is achieved by means of the fiber composite materials. Thereby the protective coating can withstand high stresses, such as a thermally induced expansion of the ceramic base body, without forming cracks or openings. The thermally induced expansion of the ceramic base body can be initiated, for instance, by application of an elevated operating voltage, which can lead locally to melting of the varistor ceramic with explosive escape of ceramic material and various reaction products, and thus to ignition of the varistor's protective coating. Consequently, this can lead to ignition of entire devices or system components in which the varistor is employed. By means of the layer containing mullite, the materials emitted from the ceramic base body, possibly harmful, can be prevented from escaping to the exterior, or the oxygen necessary for ignition can be prevented from penetrating into the interior area of the ceramic base body.

An increased strength of the varistor protective coating 2 is achieved by the addition of fiber-like organic or inorganic reinforcement materials with differing lengths, as well as by the addition of organic and organic matrix elements or composites.

Aramid fibers are preferred as a fiber 4 of organic nature. Glass fibers, carbon fibers or mineral wool are preferably used as fibers of inorganic nature. The latter have the advantage that they have a flame-retardant effect.

Suitable organic matrix elements or composite materials are silicone resins, phenolic resins or epoxy resins. Hydraulically setting ceramics and cements are preferably used as inorganic matrix element.

Glass fiber snippings 4 having a length of 0.2 mm in different mixing ratios with a silicone resin lacquer formula or phenolic resin lacquer formula are preferably mixed, so that a mixture suitable for immersion or spraying results, which can be applied to the ceramic base body. The application of protective coating 2 can be done in multiple layers until the required coating thickness is achieved. 3 to 7 immersion steps, more particularly 5, are preferred here, in order to achieve a protective coating thickness between 7 and 9 mm, since it has been shown that this thickness yields a particularly good strength, with only a relatively short manufacturing time being required.

The protective coating 2 enriched with the additives is brought to the desired high strength by a curing process characterized by a temperature increase, for example, by passing the varistor through an oven.

Figure 4:
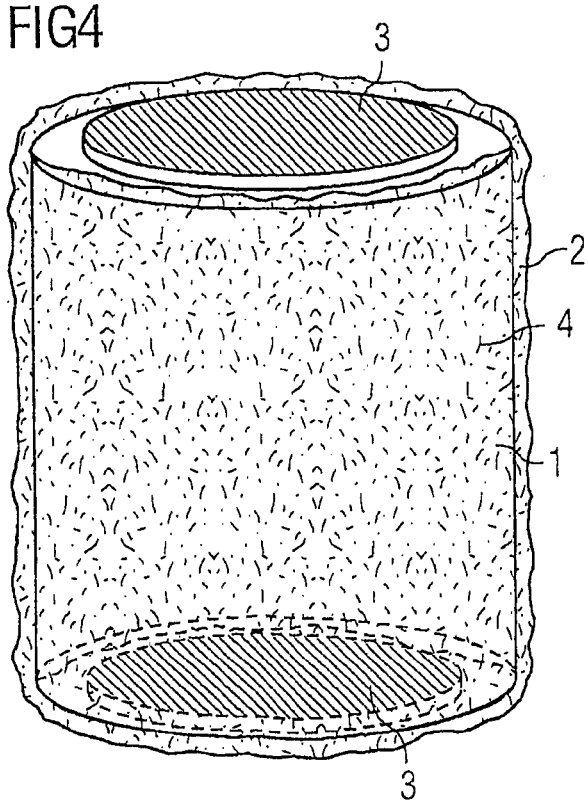
FIG. 4, a varistor according to FIG. 3 with contact bodies applied to the end faces.

A varistor 1 furnished with contact bodies 3 on its end faces is shown in FIG. 4. It is preferred that the application of protective coating 2 take place before firing of the contact body, so that the layer applied to the end faces is pressed aside or removed by the extremely high temperature during the firing of the contact bodies. Thus contact bodies 3 comprise an outward-directed free surface that can be contracted with an additional contact body. It is also possible, however, to apply contact bodies 3 to the end faces of ceramic base body 1 and subsequently immerse the varistor in a protective coating compound or liquid, the protective coating then being removed after the curing process by, for instance, an etching process, from those places where no protective coating is desired, in particular, above the contact body.

Figure 5:
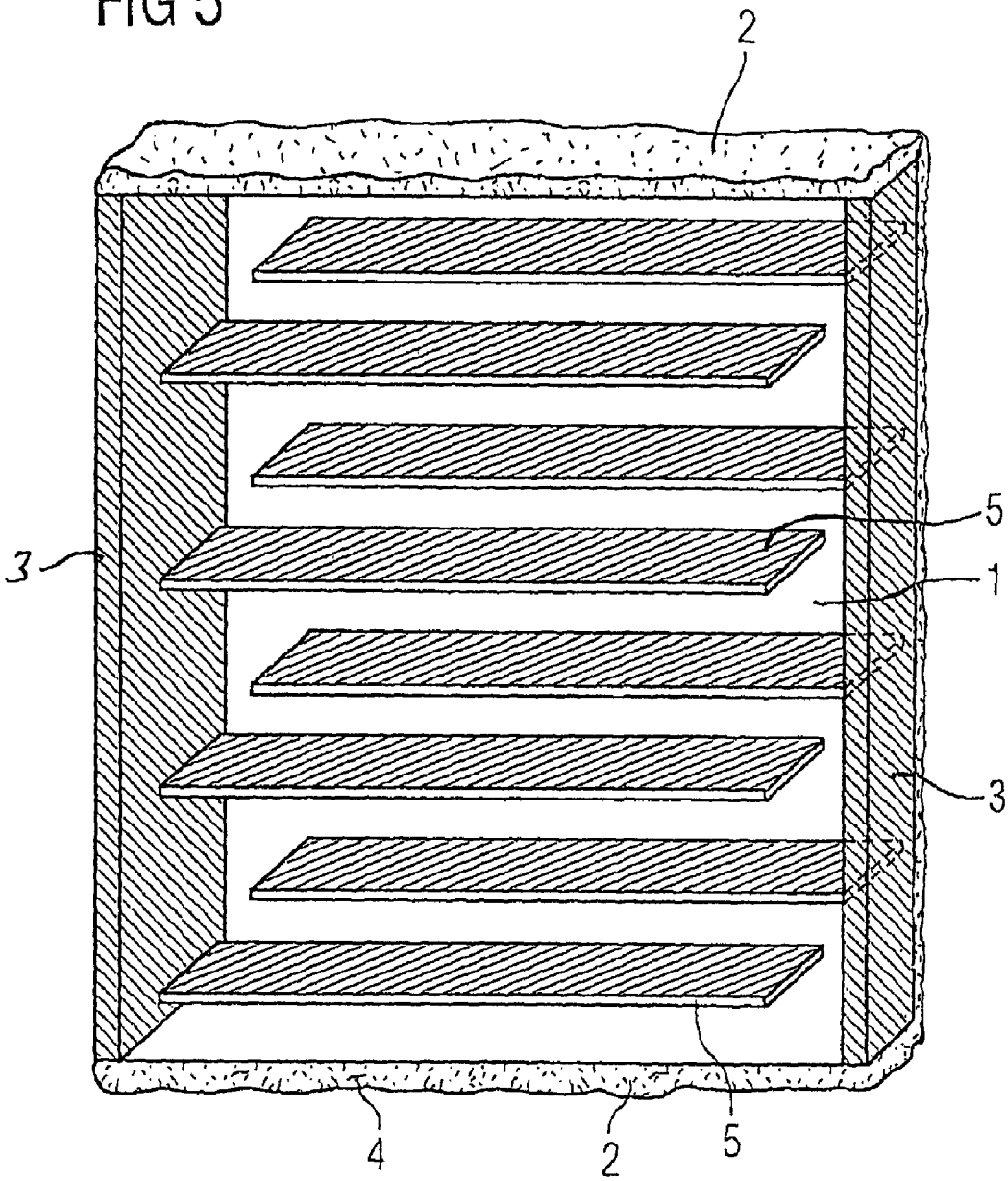
FIG. 5, an electrical component with several internal electrodes and a layer comprising fibers.

FIG. 5 shows a multilayer varistor with a ceramic base body 1, in the interior of which internal electrodes 5 are arranged, each in contact at one end with contact body or metallization 3 applied to the surface or side face of the ceramic base body. The multilayer varistor comprises an outer layer 3 comprising mullite as in the preceding embodiments, which can be enriched with material-strengthening fibers. Thus a multilayer varistor is provided which, by virtue of a high-strength, preferably flame retardant protective coating 2, is either not inflammable or is only inflammable with great difficulty, even in case of accidental or inadvertent overvoltages. As described with regard to FIG. 4, it is preferred that the metallizations 3 be free of protective coating materials.

LIST OF REFERENCE NUMBERS

1 Ceramic base body of a varistor
2 Insulating layer
3 Metallization
4 Fiber
5 Internal electrodes

The invention claimed is:

1. A varistor, comprising:
a ceramic body having a surface; and
an insulating layer on at least a portion of the surface of the ceramic body, the insulating layer comprising a base glass and a filler, wherein the filler comprises $3Al_2O_3$ $2SiO_2$;
wherein the base glass comprises ZnO and the base glass has a ZnO content by weight of from about 30% to about 50%.

2. The varistor of claim 1, wherein the insulating layer has a filler content by weight of from about 5% to about 40%.

3. The varistor of claim 1, wherein the base glass comprises $B_2O_3$ and the base glass has a $B_2O_3$ content by weight of from about 30% to about 40%.

4. The varistor of claim 1, wherein the base glass comprises CuO and the base glass has a CuO content by weight less than or equal to about 10%.

5. The varistor of claim 1, wherein the base glass comprises $P_2O_5$ and has a $P_2O_5$ content by weight of less than or equal to about 10%.

6. The varistor of claim 1, wherein the ceramic body comprises end faces comprising metallizations.

7. The varistor of claim 1, wherein the varistor comprises a multilayer varistor.

8. The varistor of claim 1, wherein the insulating layer comprises material-strengthening fibers.

9. The varistor of claim 8, wherein the material strengthening fibers comprise organic fibers.

10. The varistor of claim 1, wherein the insulating layer comprises an organic composite material.

11. The varistor of claim 1, wherein the insulating layer comprises an inorganic composite material.

12. The varistor of claim 1, wherein the insulating layer comprises a material capable of being cured by increasing a temperature.

13. The varistor of claim 8, wherein the fibers comprise inorganic fibers.

14. A varistor, comprising:
a ceramic body having a surface; and
an insulating layer on at least a portion of the surface of the ceramic body, the insulating layer comprising a base glass and filler, wherein:
the filler comprises $3Al_2O_3$ $2SiO_2$;
the insulating layer has a filler content by weight of from about 5% to about 40%; and
the base glass comprises:
from about 30% to about 50% ZnO by weight;
from about 30% to about 40% $B_2O_3$ by weight;
less than or equal to about 10% CuO by weight; and
less than or equal to about 10% $P_2O_5$ by weight.

* * * * *